US007977022B2

(12) United States Patent
Takeda et al.

(10) Patent No.: US 7,977,022 B2
(45) Date of Patent: Jul. 12, 2011

(54) DEVELOPER, PROCESS CARTRIDGE, AND IMAGE FORMING APPARATUS

(75) Inventors: Tomohiro Takeda, Kanagawa (JP); Toyofumi Inoue, Kanagawa (JP); Daisuke Ishizuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 948 days.

(21) Appl. No.: 11/802,854

(22) Filed: May 25, 2007

(65) Prior Publication Data

US 2008/0090164 A1 Apr. 17, 2008

(30) Foreign Application Priority Data

Oct. 16, 2006 (JP) ..... 2006-281479

(51) Int. Cl.
*G03G 9/00* (2006.01)

(52) U.S. Cl. ..... 430/111.4; 430/105; 430/108.6; 430/108.7; 399/111

(58) Field of Classification Search ..... 430/111.4, 430/105, 108.6, 108.7; 399/111
See application file for complete search history.

(56) References Cited

U.S. PATENT DOCUMENTS 5,262,267 A * 11/1993 Takiguchi et al. ..... 430/122.51
5,763,229 A * 6/1998 Kobayashi et al. ..... 430/108.6
6,593,051 B1 7/2003 Hirota et al.
2003/0207192 A1 11/2003 Hirota et al.
2004/0259016 A1 12/2004 Oya et al.
2005/0136352 A1* 6/2005 Vandewinckel et al. ... 430/107.1

FOREIGN PATENT DOCUMENTS

JP A-2000-181128 6/2000
JP A 2005-10614 1/2005
JP A-2005-10677 1/2005
JP A-2005-196044 7/2005

OTHER PUBLICATIONS

Dec. 14, 2010 Japanese Office Action issued in Japanese Patent Application No. 2006-281479 (with translation).
Feb. 1, 2010 Submission of Publications issued in Japanese Patent Application No. 2006-281479 (with translation).

* cited by examiner

*Primary Examiner* — Mark A Chapman
(74) *Attorney, Agent, or Firm* — Oliff & Berridge, PLC

(57) ABSTRACT

The invention provides a developer having at least a toner, an aeration ratio (AR) of the developer measured by a powder rheometer being in a range of about 5.0 to about 10.0. It is preferable that the developer further contains an external additive of silica particles having a small diameter. The invention further provides a process cartridge having at least: a photoreceptor; and a developing device that comprises plura developer storage portions and that makes visible a latent image formed on the photoreceptor by using the developer. The invention further provides an image forming apparatus having at least the process cartridge.

18 Claims, 8 Drawing Sheets

FIG. 1
FIG. 1B
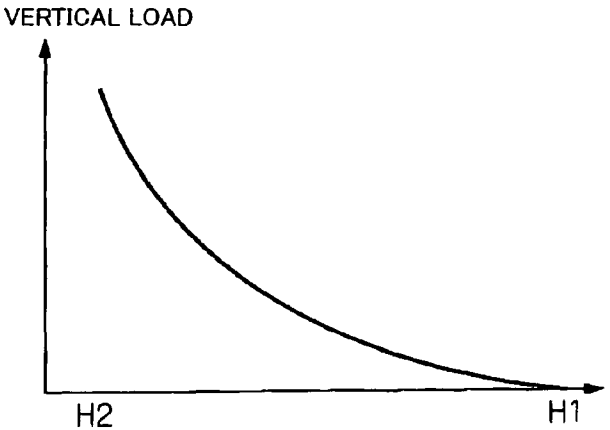
FIG. 1C
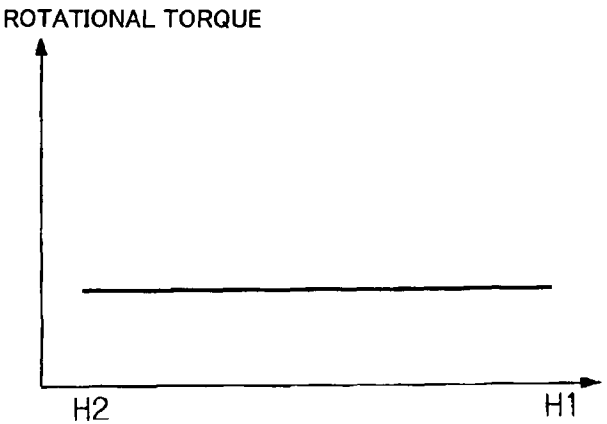
FIG. 1A
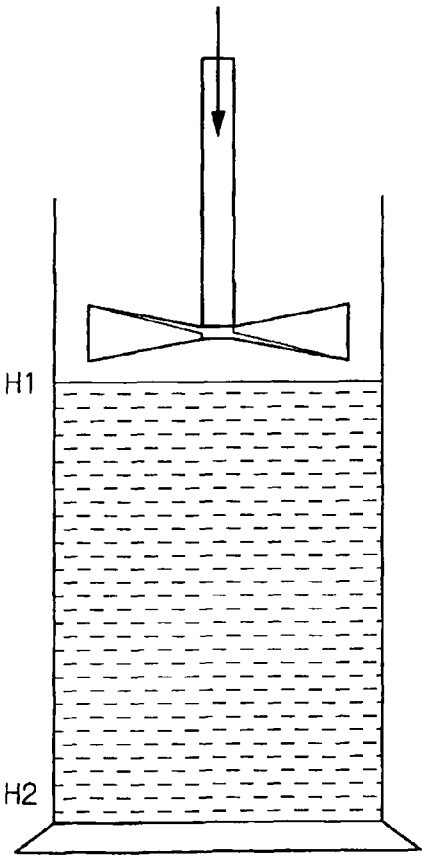

DEVELOPER, PROCESS CARTRIDGE, AND IMAGE FORMING APPARATUS

BACKGROUND OF THE INVENTION

1. Field of the Invention

The present invention relates to a developer used for an image forming apparatus such as a copying machine or printer, and a process cartridge and an image forming apparatus used therefor.

2. Description of the Related Art

A number of electrophotographic processes are known in the art. In the electrophotographic process, a fixed image is formed through a plurality of steps comprising electrically forming a latent image by various methods on a photoreceptor utilizing a photoconductive material, developing the latent image using a toner, transferring the toner latent image on the photoreceptor onto a transfer object such as a sheet of paper with or without interposition of an intermediate transfer apparatus, and fixing the latent image by heating, compressing or heating with compression, or with a vapor of a solvent. If necessary, toner remaining on the photoreceptor is cleaned off by various methods, and the aforementioned plural steps are repeated. Printers and copying machines utilizing the electrophotographic process are widely used, and accordingly, requirements with respect to performance and image quality are become more strict year by year.

Developing methods for the electrophotographic process are divided into one-component developing methods and two-component developing methods. While the two-component developing method has widely been used for development since it is advantageous for high speed processing, it involves disadvantages such as deterioration of the developer due to adhesion of the toner on the surface of a carrier and a large size of the developing device since the mixing ratio of the toner to the carrier should be kept constant so that the toner concentration in the developer does not decrease due to only the toner being consumed in this method. Consequently, the cost of controlling the toner density becomes high. On the other hand, since the one-component developing method is advantageous in that the device is compact and the cost may be reduced without producing the above-mentioned defects, the device is prevalent in small offices and in the field of personal users.

The one-component developing method is roughly divided into a non-magnetic one-component developing method and magnetic one-component developing method. The former is suitable for color printing because the toner does not contain magnetic powders. On the other hand, the magnetic one-component developing method is frequently used in a monochromatic electrostatic copying method since the toner can be retained on the toner bearing body using a magnetic force of the magnetic powder contained in the toner, and from the viewpoints of good conveying ability of the toner and easily inhibition of fogging of the toner at non-image portions.

The one-component developing method is more suitable for making the apparatus compact as compared with the two-component developing method. However, while so-called long life is urgently required for increasing the number of printing sheets (the number of copying sheets) per process cartridge in addition to the requirement for more compactness in recent years, a space for accommodating the developer is further reduced by making the process cartridge small. Consequently, the number of printing or copying sheets printed or copied before the toner in the cartridge has been depleted is reduced. Therefore, various methods have been devised for satisfying requirements of both small size and long life.

Image forming apparatuses, to which process cartridges are detachably attached to main bodies thereof, are conventionally well-known. A conventional process cartridge of a cartridge wherein a cleaning device and a developing device are disposed in a positional relationship of one above the other with the scanning light path therebetween is known.

Particularly, for the sake of reducing the width of a machine, a recording medium is not discharged to the side of the machine, but preferably the recording medium path is arranged to be substantially vertical from a transferring step to a fixing step, to discharge the recording medium at an upper portion of the machine. However, the developing device is disposed under the scanning light path in an image forming apparatus as described above. Thus, since the developing device is disposed under the scanning light path, there is a need to reduce the size of the developing device in order to reduce the height of the apparatus. The developing device contains a developer storage portion for storing developer, so that the storage portion for the developer must be reduced, and it has been difficult to reduce the size of the apparatus while maintaining the developer storage capacity of the developer storage portion.

SUMMARY OF THE INVENTION

The present invention was accomplished in view of the foregoing circumstances.

Namely, the invention can provide a developer, a process cartridge and an image forming apparatus that ensure a developer storage capacity without reducing a space for the developer in the developing device while providing both long life and a small apparatus size, and that can also maintain a stable image quality by substantially preventing occurrence of non-uniformity in color concentration until the toner in the process cartridge is exhausted.

A first aspect of the invention is to provide a developer comprising a toner, an aeration ratio (AR) of the developer measured by a powder rheometer being in a range of about 5.0 to about 10.0.

A second aspect of the invention is to provide a process cartridge comprising: a photoreceptor; and a developing device that comprises plural developer storage portions and that makes visible a latent image formed on the photoreceptor by using a developer comprising a toner having an aeration ratio (AR) measured by a powder rheometer being in a range of about 5.0 to about 10.0.

A third aspect of the invention is to provide an image forming apparatus comprising a process cartridge comprising: a photoreceptor; and a developing device that comprises a plurality of developer storage portions and that makes visible a latent image formed on the photoreceptor by using a developer comprising a toner having an aeration ratio (AR) measured by a powder rheometer being in a range of about 5.0 to about 10.0.

BRIEF DESCRIPTION OF THE DRAWINGS

FIGS. 1A to 1C are schematic diagrams for explaining a method for measuring an amount of a total energy by using a powder rheometer.

DETAILED DESCRIPTION

Developer

Figure 2:
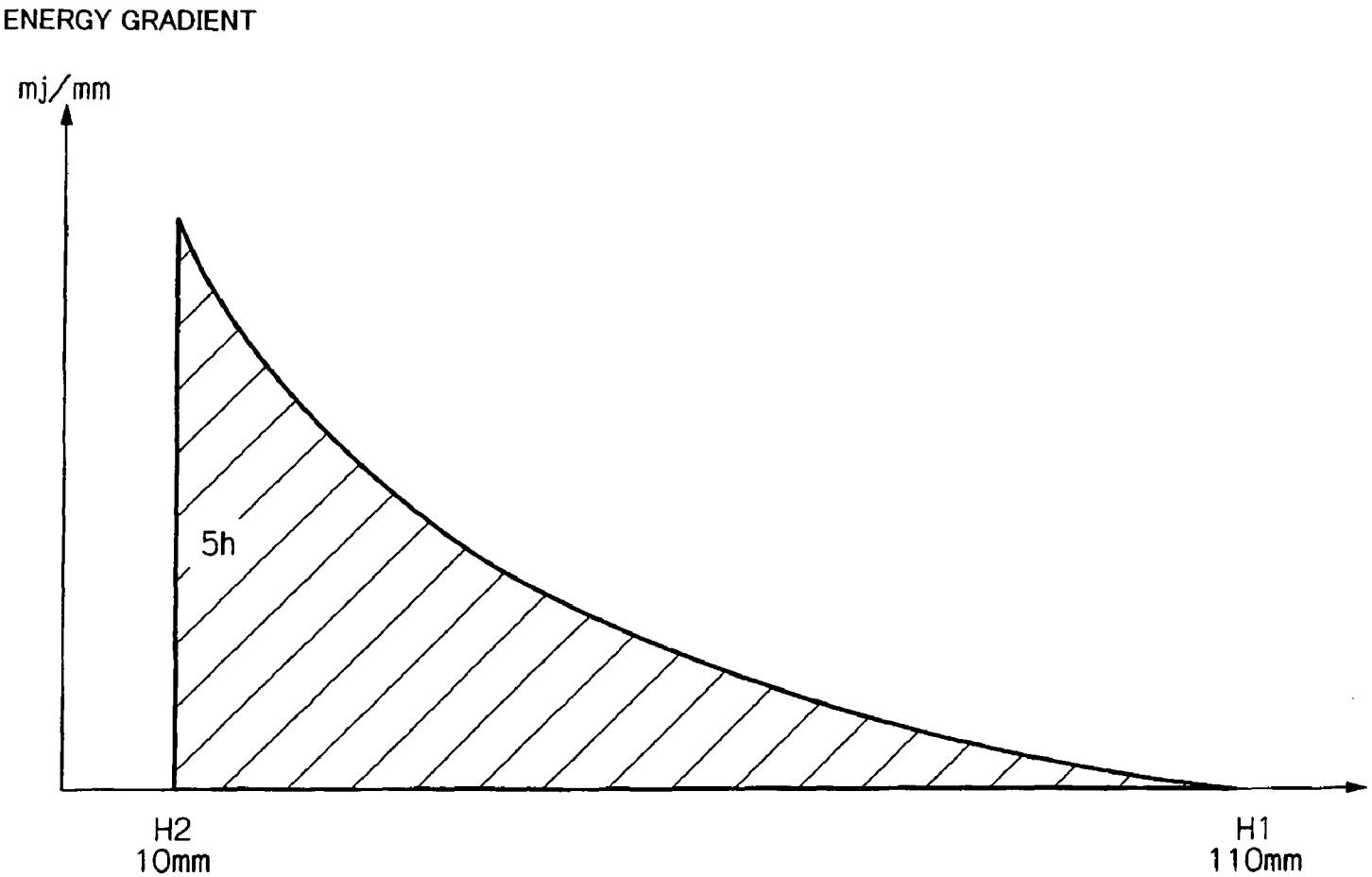
FIG. 2 is a schematic diagram showing the relationship between an energy gradient, obtained using a power rheometer, and a vertical load.

The developer of the present invention has an aeration ratio AR measured by a powder rheometer of about 5.0 to about 10.0. In the following, a method for measuring with the powder rheometer will be described.

The powder rheometer is a fluidity measuring device which directly determines fluidity by measuring the rotational torque and the vertical load at the same time, obtained by helically rotating a moving blade with particles filled thereabout. Since both of the rotational torque and the vertical load are measured, a highly sensitive detection can be made of the fluidity of the powder itself and of the influences of the external environment. Moreover, the measurement is conducted while keeping the filling conditions of the particles constant, so that data may be obtained with good reproducibility.

In the present invention, measurement of the aeration ratio is implemented by using a powder rheometer FT4 (trade name, manufactured by Freeman Technology).

First, a split container having 50 mm internal diameter (which is composed of a cylinder of 51 mm height disposed on a container having 89 mm height and 160 mL capacity, and arranged so as to be separable in the vertical direction) is filled with a developer until the developer exceeds 89 mm height of the split container.

After the developer is filled, the filled developer is gently agitated, whereby the sample developer is homogenized. This operation is referred to as "conditioning" hereinafter.

In conditioning, in a filled state, the moving blade is gently rotated in the rotational direction in which resistance is not received from the developer so as not to apply stress to the developer (counterclockwise direction viewed from above), whereby excessive air and substantially all the local stress is removed, so that the condition of the sample becomes homogeneous. Specifically, the agitation is conducted with conditioning conditions of a 5° angle of approach, and 60 mm/s tip speed of the moving blade.

During this agitation, since the moving blade having a propeller shape moves downwards as well as rotating, the tip of the moving blade draws a helical trace. The angle of the helical path drawn by the propeller tip is called the "angle of helical path downward". After repeating the conditioning operation four times, an upper end portion of the split container is moved carefully, and the developer inside the vessel is leveled off at the position of 89 mm height to obtain the developer in an amount to fill the 160 mL container. Such a conditioning operation is carried out since it is important to obtain a constant volume of a powder which is always stable in order to stably derive the stable total energy in the present invention.

The resulting developer obtained as described above is transferred to a container having 200 mL capacity, 50 mm internal diameter, and 140 mm height.

After transferring the developer to the 200 mL container, the conditioning operation is carried out a further five times, and thereafter the rotational torque and the vertical load are measured in the case where the moving blade is rotated, at 100 mm/s tip speed, without causing air to flow in while moving the moving blade at a −5° angle of approach in the container in a height range of from 110 mm to 10 mm from the bottom thereof. Here, the rotational direction of the propeller is the opposite direction to that of conditioning (clockwise direction viewed from above).

Also, the rotational torque and the vertical load are measured with respect to the same sample in the case where the moving blade is rotated, at 100 mm/s tip speed, while causing air to flow in while moving the moving blade at −5° angle of approach in the container in a range of a height from 110 mm to 10 mm from the bottom thereof. In this case, the rotational direction of the propeller is also the opposite direction to that of conditioning (namely, clockwise direction viewed from above) similarly to the case without air flowing in. With the increase in the amount of aeration, the total energy decreases, but when aeration exceeds a certain amount, the total energy exhibits a constant value. When the FT4 (trade name, manufactured by Freeman Technology) is used, it is possible to set the flow conditions to a desired amount of aeration.

The reason why an angle of approach is set to be −5° is that the angle of helical path downward has a high correlation with the fluidity of the developer in a developing device. In addition, the "angle of helical path downward" also means the angle formed between the axis of the measuring container and the rotational axis of the moving blade.

Then, aeration is stopped in a state where total energy is sufficiently reduced, and deaeration treatment is carried out twice. The rotational direction in this case is the counterclockwise direction when viewed from above, the same as when conditioning. The ratio AR of the total energy the first time to the total energy the second time of the deaeration treatment is in a range of about 5.0 to about 10.0 in the toner of the present invention.

FIG. 1A is a schematic diagram showing a condition wherein a moving blade is entered into a container into which particles are filled. A relationship of a vertical load with respect to a height H from the bottom is shown in FIG. 1B, while a relationship of a rotational torque with respect to a height H from the bottom is shown in FIG. 1C. The result of an energy gradient (mJ/mm) with respect to the height H determined from the rotational torque and the vertical load is shown in FIG. 2. The area (the shaded portion in FIG. 2) obtained by integrating the energy gradient of FIG. 2 corresponds to the amount of the total energy (mJ). In the present invention, the section extending from 10 mm to 110 mm from the bottom is integrated to determine the amount of total energy.

Figure 3:
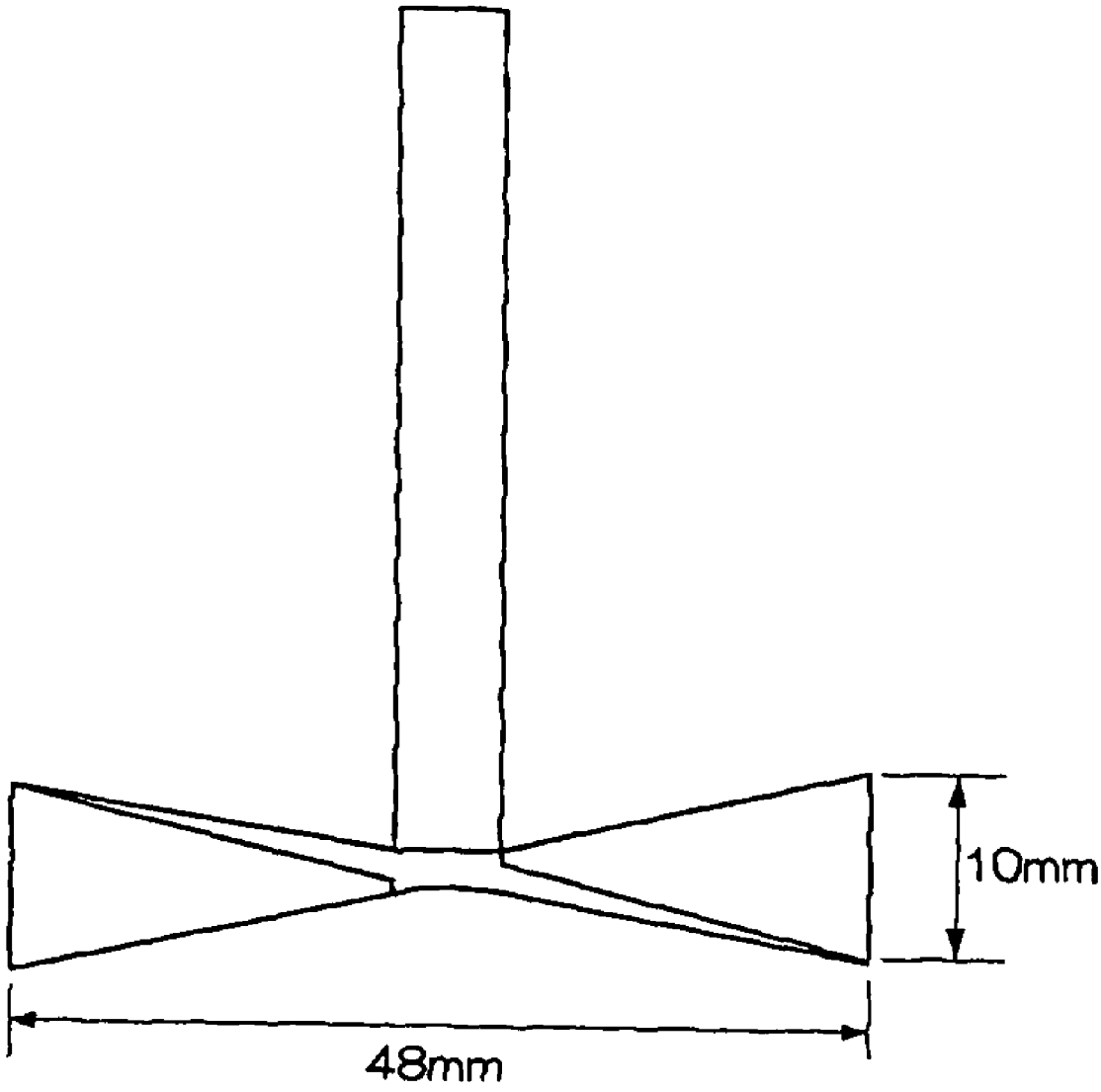
FIG. 3 is a schematic diagram for explaining the shape of a moving blade used in the powder rheometer.

A $\phi$ 48 mm diameter blade having a two-vane propeller shape (a length of the end of the propeller part: 10 mm) manufactured by Freeman Technology and shown in FIG. 3 are used as the moving blade.

It may be considered that the numerical value represented by the ratio of the first and second deaeration treatments (aeration ratio AR) indicates the degree of ease of loss of fluidity of a toner by deaeration treatment with respect to the total energy amount when the toner has been sufficiently aerated. In other words, the degree of compaction of a developer due to such deaeration treatment increases with an increase in the numerical value, meaning that the supply of a developer from the first developer chamber to the second developer chamber flows readily and stops readily.

When the AR is less than about 5.0, since the fluidity is less likely to be lost even if deaeration treatment is carried out, supply of a toner to the second developer chamber becomes excessive. As a result, variations in the amount of developer arise in the second developer chamber. On the other hand, when the AR exceeds about 10.0, the fluidity is largely lost by deaeration treatment, so that clogging of the developer is generated in the paths extending from the first developer chamber to the second developer chamber. Thus, the AR is preferably in a range of about 5.5 to about 9.0, and is more preferably in a range of about 6.0 to about 8.0.

While it may be considered that the amount and the particle diameter of silica particles having a small diameter, which may be added to the toner as an external additive in order to afford fluidity thereto, predominate the total energy amount when rotating a propeller, however it may be considered that particularly significant factors for varying the AR are the toner particle diameter, particle size and the like. Since the larger the particle diameter of a toner the easier it is to pass air through during aeration, the total energy becomes low. In contrast, since the air in the toner is easily released during deaeration, the total energy becomes high, so that the larger the particle diameter of a toner the higher the AR value.

It is considered that satisfying at least one of the following conditions (1) to (4) is sufficient to control the AR to within a range of about 5.0 to about 10.0.

(1) The amount contained of the silica particles having a small diameter with respect to 100 parts by weight of the developer is in a range of about 0.5 to about 1.5 parts by weight.

(2) A volume average particle diameter of the silica particle having a small diameter is in a range of about 0.005 to about 0.05 μm.

(3) A volume average particle diameter of the toner is in a range of about 5 to about 15 μm.

(4) A particle size distribution of the toner is such that i a number percentage of particles of 4 μm or less is 20% or less with respect to the total number of particles of the toner.

It is preferable that, from the conditions (1) to (4), the conditions (1) and (4) are satisfied in the toner of the invention.

The other constituent elements of the developer according to the present invention are not particularly limited, and any conventionally-known materials may be used. The present developer is preferably a one-component developer that is a developer having a toner containing at least magnetic particles.

Examples of a resin which can be used as the binder resin for preparing the developer of the invention include homopolymers or copolymers of styrenes such as styrene or chlorostyrene; monoolefins such as ethylene, propylene, butylene or isobutylene; vinyl esters such as vinyl acetate, vinyl propionate, vinyl benzoate, or vinyl butylate; esters of α-methylene aliphatic monocarboxylic acid such as methyl acrylate, ethyl acrylate, butyl acrylate, butyl acrylate, octyl acrylate, dodecyl acrylate, phenyl acrylate, methyl methacrylate, ethyl methacrylate or dodecyl methacrylate; substituted ethylenic monocarboxylic acid such as acrylonitrile, methacrylonitrile and acrylamide; ethylenic carboxylic acid and esters thereof such as dimethyl maleate, diethyl maleate and dibutyl maleate; vinyl ether such as vinylmethyl ether, vinylethyl ether, or vinylbutyl; and vinyl ketones such as vinylmethyl ketone, vinylhexyl ketone or vinylisopropenyl ketone.

Representative examples of the binder resin include a styrene-acrylic acid alkyl copolymer, a styrene-methacrylic acid alkyl copolymer, a styrene-acrylonitrile copolymer, a styrene-butadiene copolymer, a styrene-maleic acid anhydride copolymer, polyethylene, polypropylene and the like. Representative examples of the binder resin further include polyester resins, polyurethane resins, epoxy resins, silicone resins, polyamide, and denatured rosin. Among these, styrene-(meth)acrylic acid alkyl copolymers and polyester resins can be preferably used in the invention. In view of fixation property at low temperature, polyester resins are particularly preferably used in the invention.

As the toner, a one-component magnetic toner containing a magnetic powder as a coloring agent is most preferably used. The magnetic powder to be dispersed in the binder resin include conventionally known magnetic materials such as metals such as iron, cobalt or nickel, and alloys thereof; metal oxides such as $Fe_3O_4$, $\gamma$-$Fe_2O_3$ or iron oxide supplemented with cobalt; various ferrites such as Mn—Zn ferrite or Ni—Zn ferrite; magnetite and hematite. These materials may be treated with a surface treating agent such as a silane coupling agent or titanate coupling agent, may be coated with an inorganic material such as silicon compounds and aluminum compounds, or alternatively may be coated with a polymer.

These magnetic powders may be mixed in a proportion ranging preferably from about 35 to about 55% by weight, and more preferably from about 40 to about 50% by weight, relative to a total amount of the toner particles. A binding force of the toner bearing body by magnetism may decrease when the proportion of the magnetic powder is less than about 35% by weight, and the problems of scattering of the toner and fogging may sometimes occur. On the other hand, image density may decrease when the proportion of the magnetic powder exceeds about 55% by weight. The magnetic powder having an average particle diameter of about 0.05 to about 0.35 μm is preferably used from the viewpoint of dispersability thereof in the binder resin. A nonmagnetic powder may occasionally be simultaneously used in order to adjust the coloring property.

Inorganic particles may be also preferably added to the toner of the invention for improving durability and fluidity of the toner. Examples of the inorganic particles to be added include particles of metal oxides and ceramics such as silica, aluminum oxide, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, magnesium carbonate, zirconium oxide, silicon carbide, silicon nitride, calcium carbonate or barium sulfate. The particles are more preferably those mainly containing silica particles, aluminum oxide particles, titanium oxide particles, or zinc oxide particles among them. These particles may be used alone or in combination thereof. Preferable examples of the inorganic particles include those mainly containing titanium oxide or those mainly containing silica, and particularly preferable examples thereof include those mainly containing silica.

The particles may be subjected to a treatment for imparting hydrophobicity so as to improve durability and fluidity. Such a hydrophobilization treatment is applied using an ordinary hydrophobic treatment agent.

Specific examples of the hydrophobic treatment agent include coupling agents such as a silane coupling agent, a titanate coupling agent, an aluminate coupling agent or a zirconium coupling agent, as well as silicone oil and polymer coating. These hydrophobic treatment agents may be used alone or in combination thereof. Among these, the silane coupling agent and the silicone oil are preferably used in the invention.

Any silane coupling agent, such as chlorosilane, alkoxysilane, silazane or special sililation agents, may be used in the invention. Examples thereof include methyl trichlorosilane, dimethyl dichlorosilane, trimethyl chlorosilane, phenyl trichlorosilane, diphenyl dichlorosilane, tetramethoxy silane, methyltrimethoxy silane, dimethyldimethoxy silane, ethyltrimethoxy silane, propyltrimethoxy silane, phenyltrimethoxy silane, diphenyldimethoxy silane, tetraethoxy silane, methyltriethoxy silane, dimethyldiethoxy silane, ethyltriethoxy silane, propyltriethoxy silane, phenyltriethoxy silane, diphenyldiethoxy silane, butyltrimethoxy silane, butyltriethoxy silane, isobutyltrimethoxy silane, hexyltrimethoxy silane, octyltrimethoxy silane, decyltrimethoxy silane, hexadecyltrimethoxy silane, trimethyltrimethoxy silane, hexamethyl disilazane, N,O-(bistrimethylsilyl)acetamide, N,N-bis(trimethylsilyl) urea, tert-butyldimethyl chlorosilane, vinyl trichlorosilane, vinyltrimethoxy silane, vinyltriethoxy silane, vinyltriacetoxy silane, γ-methacryloxypropyl trimethoxysilane, β-(3,4-epoxycyclohexyl)ethyltrimethoxy silane, γ-glycidoxypropyl trimethoxy silane, γ-glycidoxypropyl triethoxysilane, γ-glycidoxypropylmethyl diethoxysilane, γ-mercaptopropyl trimethoxysilane, and γ-chloropropyl trimethoxysilane; fluorinated silane compound in which a part of hydrogen atoms in the above silane compound are substituted with fluorine atoms such as trifluoropropyl trimethoxysilnae, tridecafluorooctyl trimethoxysilane, heptadecafluoro trimethoxysilane, heptadecafluorodeyl methyldimethoxysilane, tridecafluoro-1,1,2,2-tetrahydrooctyl triethoxysilane, 3,3,3-trifluoropropyl trimethoxysilane, heptadecafluoro-1,1,2,2-tetrahydrodecyl triethoxysilane, or 3-heptafluoroisopropoxypropyl triethoxysilane; and aminosilane compounds in which a part of hydrogen atoms are substituted with amino groups, while the silane coupling agent is not limited to these compounds.

Examples of the silicone oil include dimethyl silicone oil, methylhydrogen silicone oil, methylphenyl silicone oil, cyclic dimethyl silicone oil, epoxy-modified silicone oil, carboxyl-modified silicone oil, carbinol-modified silicone oil, methacryl-modified silicone oil, mercapto-modified silicone oil, polyether-modified silicone oil, methylstyryl-modified silicone oil, alkyl-modified silicone oil, amino-modified silicone oil, and fluorine-modified silicone oil, while the silicone oil is not restricted to these.

The charge amounts at a high humidity may be increased by using the particles subjected to hydrophobilization treatment, whereby environmental stability of the charge amounts may be improved.

The method for subjecting the particles to hydrophobilization treatment include any methods known in the art, such as a method including: dropping or spraying a treatment agent diluted with a solvent such as tetrahydrofuran, toluene, ethyl acetate, methylethyl ketone, acetone or the like onto the particles forcedly stirred using a blender for thoroughly mixing; drying with heating (after washing and filtering, if necessary); and pulverizing the aggregates after drying in a blender or mortar: a method including drying the particles after immersing them in a solution of the treatment agent; a method including: dropping the solution of the treatment agent in an aqueous slurry of the particles; and drying with heating precipitated particles followed by pulverizing: and a method including directly spraying the treatment agent onto the particles.

The adhering amount of the treatment agent onto the particles is preferably in a range of about 0.01 to about 50% by weight, and is more preferably in a range of about 0.1 to about 25% by weight. The adhering amount may be varied by increasing the mixing amount of the treatment agent in treating, or by changing the number of washing steps after the treatment. The adhering amount of the treatment agent onto the particles may be quantified by XSP, elementary analysis or the like. Charge amounts may be decreased under a high humidity environment when the adhering amount of the treatment agent is too small. An excessive charge amount may occur or a released treating agent may deteriorate fluidity of the powder under a low humidity environment when the amount of the treating agent is too large.

Organic particles may also be added to the toner, in addition to the inorganic particles. Examples of the organic particles include particles of vinyl polymers such as styrene polymer, (meth)acrylic polymer or ethylene polymer; particles of other polymers such as ester, melamine, amide or allyphthalate polymers; particles of fluorinated polymers such as fluorovinylidene polymers; and particles of higher alcohols such as unilin. Particles having a primary particle diameter of from about 0.05 to about 7.0 μm are preferably used. The organic particles are usually added to the toner for improving cleaning ability and transferring ability.

The particles to be added to the toner may be adhered onto the surface of the toner particles by applying a mechanical impact force to the particles together with the toner particles using a sample mill or Henschel mixer.

The toner of the developer of the invention preferably contains a wax for improving offset resistance. Examples of usable wax include hydrocarbon wax such as polypropylene or polyethylene, microcrystalline wax, silicone resin, rosin, ester wax, rice wax, carnauba wax, Fischer-Tropsch wax, montan wax and candellila wax. Among these, waxes, a melting point of each thereof is in a range of about 100 to about 140° C., are preferable in view of fluidity, and specific preferable examples thereof include polypropylene wax.

Coloring agents may be added to the toner for controlling color tone. The coloring agent known in the art may be used without particular limitation, and may appropriately be selected depending on the object. Examples of the coloring agent include carbon black, lamp black, DuPont oil red, orient oil red, rose Bengal, C.I. pigment red 5, 112, 123, 139, 144, 149, 166, 177, 178, 222, 48:1, 48:2, 48:3, 53:1, 57:1 and 81:1, pigment orange 31 and 43, quinoline yellow, chrome yellow, C.I. pigment yellow 12, 14, 17, 93, 94, 97, 138, 174, 180 and 188, ultramarine blue, aniline blue, carcoil blue, methylene blue chloride, copper phthalocyanine, C.I. pigment blue 15, 60, 15:1, 15:2 and 15:3, C.I. pigment green 7, malachite green oxalate, and nigrosine dye, each of which may be used alone or in combination of two or more thereof and which may be dispersed in advance by flushing.

Various additives may be added to the toner for controlling the charge amount. Additives such as fluorinated surfactants, salicylic acid complexes, iron dyes such as iron complexes, chromium dyes such as chromium complexes, macromolecular acids such as a copolymer containing maleic acid as a monomer component, quaternary ammonium salts or azin dyes such as nigrosine may be added in a range of about 0.1 to about 10.0% by weight relative to a total weight of the toner. Addition of the charge controlling agent is not always necessary when the binder resin has a sufficient charge controlling function.

The toner may be produced according to conventionally known production methods. The production method is not particularly restricted, and may be selected depending on the object. Examples of the production method include kneading-pulverizing method, kneading-freezing-pulverizing method, dry-in-liquid method, shear-pulverization method which includes stirring the molten toner in a non-dissolving liquid, pulverizing method including jet-spraying after dispersing the binder resin and the coloring agent in a solvent, emulsion-aggregation method using a resin prepared by emulsion polymerization, suspension polymerization, and dissolution-suspension method.

The toner for use in the invention preferably has the charge amount in a range of about −0.3 to about −20.0 (μC/g) as measured by a suction method. High image density may not be obtained when the charge amount is too low, while fogging may increase when the charge amount is too high. The triboelectric measurement method by the suction method will be briefly described below. An exhaust port of a metal vessel having suction-exhaust ports and having a mesh with a pore size small enough to prevent the toner from passing through inside is connected to a vacuum pump. The vessel is also connected to a Coulomb meter, and the suction port is electrically insulated with a rubber cover. The toner on the toner bearing body is sucked simultaneously with evacuating operation, and the charge amount is measured with the Coulomb meter. The charge amount per unit weight can be measured by measuring a difference in a weight of the vessel before and after suction.

Process Cartridge and Image Forming Apparatus

The process cartridge of the invention has at least: a photoreceptor; and a developing device that has at least a plurality of developer storage portions and that makes visible a latent image formed on the photoreceptor by using a developer having at least a toner having an aeration ratio (AR) measured by a powder rheometer being in a range of about 5.0 to about 10.0. Further, the image forming apparatus of the invention has a configuration in which the process cartridge is provided.

When the developer storage space is, for example, divided into the upper and the lower sections, the lower second developer storage section can be replenished by the developer contained in the upper first developer storage section, even if a capacity for storing the developer in the second developer storage section is reduced. In this case, when a developer is used having an aeration ratio AR measured by a powder rheometer that is in a range of about 5.0 to about 10.0, it becomes possible to feed the developer stably. As a result, excellent picture quality may be maintained wherein no uneven density appears from the initial use up to the end of the life of the developer.

When a scanning laser exposure device is used as a means for forming the latent image, an window constituting the scanning light path may be formed between the first developer storage portion and the second developer storage portion in the developing device for ensuring the path of scanning light output from the scanning laser exposure device, and the first developer storage portion and the second developer storage portion may be vertically separated with interposition of this window. The developer path is preferably provided at both sides of the window.

A first stirring-and-conveying member for conveying the developer from the center to both sides with stirring is preferably provided in the first developer storage portion. While the first stirring-and-conveying member may be composed of a wire material or formed into a crank, it is preferably formed into a coil having different winding directions from the center in the vertical direction to both sides.

A second stirring-and-conveying member for conveying the developer from both sides to the center with stirring is also preferably provided in the second developer storage portion. This configuration renders a feeding amount of the developer to be uniform in the axial direction. However, it is not necessary for the second stirring-and-conveying member to have a specific structure when fluidity of the developer is enough, and in such a case, the member may have a crank shape.

The present inventors have found that by using a process cartridge including an image holding member, and including a developing device that makes a latent image formed on the image holding member visible and that has a developer storing space, the process cartridge including the characteristics stated below, a capacity for storing developer may be secured without reducing the developer space in the process cartridge while the size of the machine the process cartridge is contained in may be decreased, and excellent picture images may be maintained without the appearance of uneven density from the beginning of use to the end of the life of the process cartridge. The characteristics are that: the space for containing the developer is, for example, divided vertically into a first developer storage portion and a second developer storage portion, with the latent image writing position of the image holding member where the latent image is written is sandwiched between the first and second developer storage portions, and the first developer storage portion is communicated with the second developer storage portion through the developer path; and the developer has an aeration ratio AR measured by a powder rheometer of about 5.0 to about 10.0.

The preferable embodiment of the present invention will be described with reference to the drawings. The members having substantially the same function are shown with the same reference numeral throughout the drawings.

Figure 4:
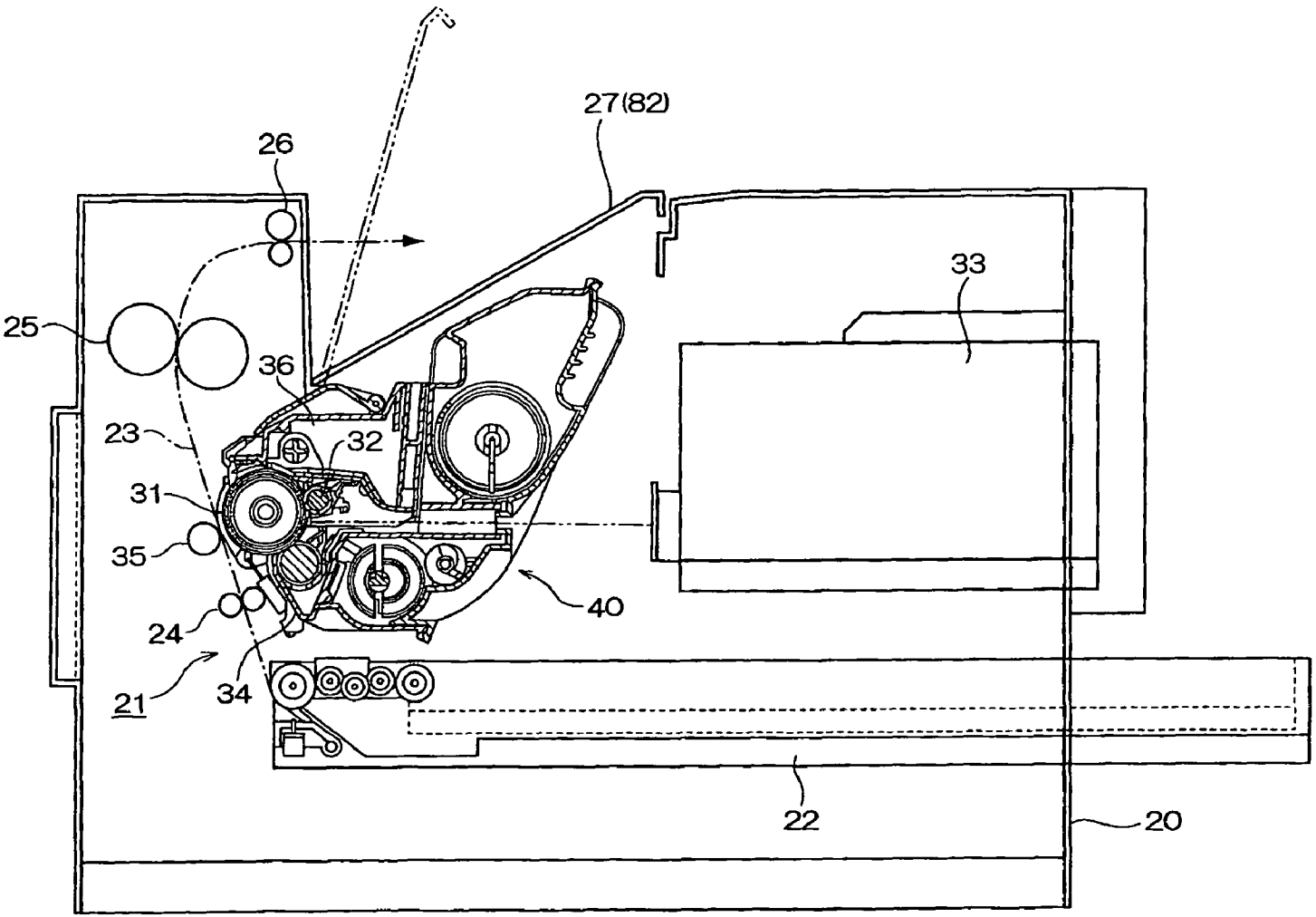
FIG. 4 is a cross sectional view showing an image forming apparatus according to an embodiment of the present invention.
Figure 5:
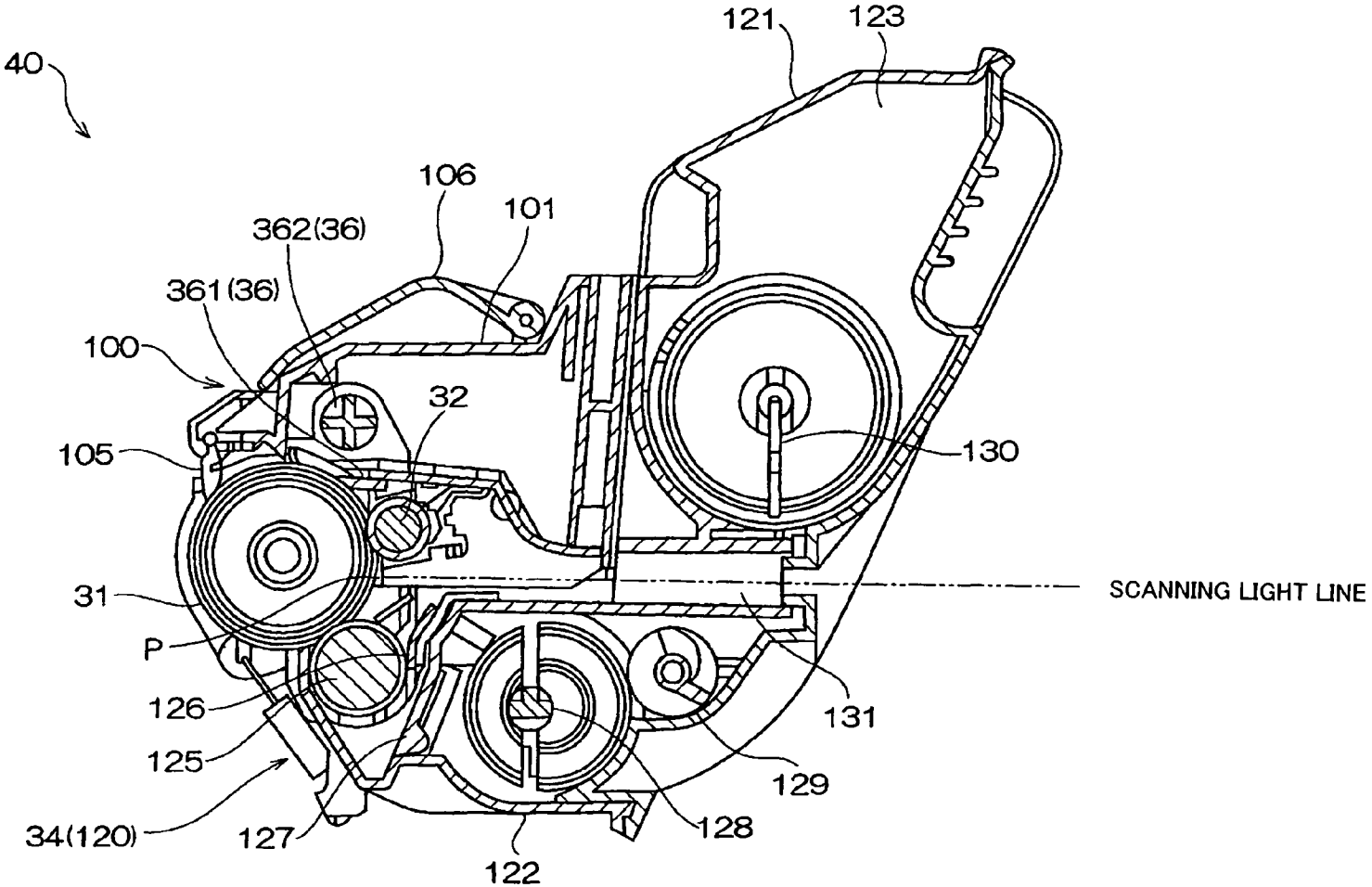
FIG. 5 is a cross sectional view showing a process cartridge according to an embodiment of the invention.
Figure 6:
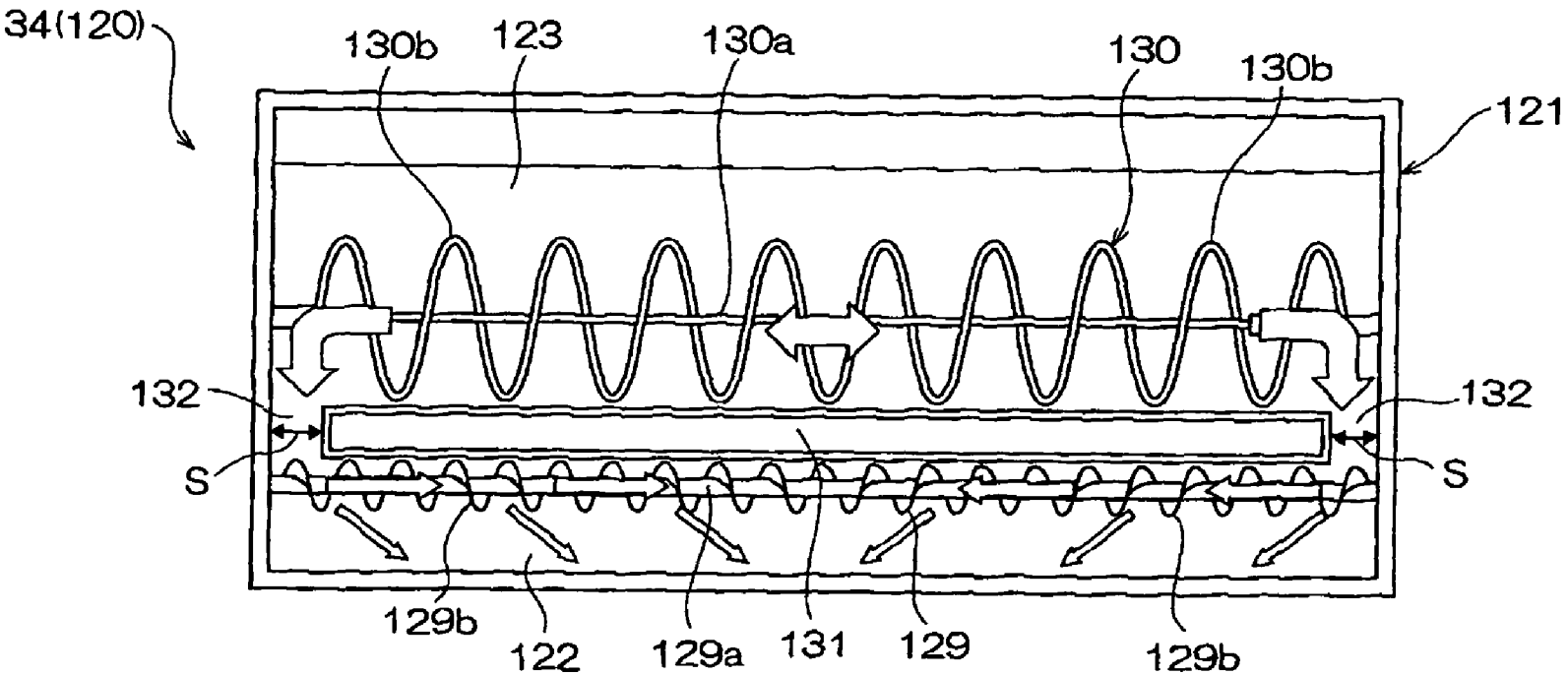
FIG. 6 is a front view showing a feeding path of a developer (toner) in the process cartridge relating to the embodiment of the invention.

FIG. 4 is a schematic view showing an entire construction of the image forming apparatus according to an embodiment of the invention. FIG. 5 is a schematic view showing the process cartridge according to an embodiment of the invention. FIG. 6 is a front view showing the feeding path of the developer in the process cartridge according to an embodiment of the invention.

The image forming apparatus of the embodiment of the invention is equipped with, for example, an electrophotographic image-forming engine 21 in the apparatus 20 of the device as shown in FIG. 4. A sheet feeding device 22 is provided beneath the image-forming engine 21 in the apparatus 20 while the upper portion of the apparatus 20 is constructed as a discharging tray 27. A sheet feeding path 23 is provided such that the sheet having been fed from the sheet feeding device 22 at the back side (left side in FIG. 1) of the apparatus 20 is guided to the image-forming engine 21 and discharging tray 27.

An electrophotographic method is employed, for example, in the image-forming engine 21, which comprises a photoreceptor drum 31, a charging device (an charging roll in this example) 32 for charging of the photoreceptor drum 31, an exposing device 33 such as a laser scanning unit for writing an electrostatic latent image (hereinafter referred to as a latent image) on the charged photoreceptor drum 31, a developing device 34 for developing the latent image on the photoreceptor drum 31 with a toner, a transferring device (a transferring roll in this example) 35 for transferring a visible image (a toner image) on the photoreceptor drum 31 onto a sheet, and a cleaning device 36 for cleaning the toner that remains on the photoreceptor drum 31.

A resist roll 24 for conveying the sheet with positioning is provided at an upstream of the photoreceptor drum 31 in the sheet conveying path 23, and a fixing device 25 is disposed at a downstream of the photoreceptor drum 31 in the sheet conveying path 23. A discharging roll 26 is arranged immediately before the discharging tray 27.

Most of the devices of the imaging engine 21 are integrated as a process cartridge 40. In other words, the process cartridge 40 incorporates the photoreceptor drum 31, the charging device 32, the developing device 34 and cleaning device 36 in a state to allow freely attachable and detachable to the apparatus 20 to form a so called CRU (Customer Replaceable Unit), as shown in FIG. 5.

The process cartridge 40 has a construction in which a photoreceptor cartridge 100 having the photoreceptor drum 31 and a developer cartridge 120 having the developing device 34 as a cartridge are integrated. The process cartridge is freely attachable to and detachable from the apparatus 20 by opening a shutter cover 82 provided at the upper portion of the apparatus 20.

While it is not shown in FIG. 5, the photoreceptor cartridge 100 is supported by a pin to the developer cartridge 120 so as to be freely swung, and is pressed in a given direction with a bias spring.

Each of sub-cartridges (photoreceptor cartridge 100 and developer cartridge 120) constituting the process cartridge 40 will be described below.

The photoreceptor cartridge 100 has the photoreceptor drum 31, the charging device (charging roll) 32 for charging the drum, and the cleaning device (an embodiment comprising a cleaning blade 361 and a conveying paddle 362 in this example) 36 for cleaning the photoreceptor drum 31, housed in a cartridge case 101.

While it is not shown in FIG. 5, the photoreceptor drum 31 and charging device (charging roll) 32 are rotationally held in the cartridge case 101 via drum bearings and roll bearings (not shown), respectively.

The cleaning device 36 is composed of a part of the cartridge case 101 as a cleaning case, which has a cleaning blade 361 disposed in contact with the photoreceptor drum 31, provided at the edge of the cleaning case, and a conveying paddle 362 that conveys remaining toner scraped with a cleaning blade 361 provided in the vicinity of the opening of the cleaning case to the back of the cleaning case. The transferring paddle 362 is rotated through a paddle gear.

A peeling finger 105 for peeling a sheet is provided at a downstream of the transferring part.

The reference numeral 106 denotes a shatter and a shaft thereof for opening and closing the surface of the developing region, if necessary, of the photoreceptor drum 31 arranged in the cartridge case 101.

A developing method using a one-component developer method is employed, for example, in the developer cartridge 120 as a cartridge of the developing device 34. A cartridge case 121 has a development housing 122 (a second developer storage portion) and a toner feeding box 123 (a first developer storage portion). The region having the development housing 122 and toner feeding box 123 corresponds to a developer storage space.

A development roll 125 is disposed at a position facing the photoreceptor drum 31 of the development housing 122. A layer thickness-controlling blade 126 for controlling the thickness of the developer layer is provided around the developing roll 125, and a supporting agitator 127 for stirring the toner is further disposed at the back side of the developing roll 125. An agitator 128 for feeding the supplied toner to the developing roll is also provided at the back side of the developing roll.

A dispense auger 129 (a second stirring-and-conveying member) for uniformly feeding the toner supplied to the development housing 122 is disposed at the back side of the agitator 128 in the development housing 122.

A toner agitator 130 (a first stirring-and-conveying member) is provided, which delivers the supplied toner to the development housing 122 with stirring through a toner feeding duct 132 in the toner feeding box 123.

A scanning path 131 (a window) having, for example, a square cross section for permitting a scanning light from the exposing device 33 to pass through is open between the development housing 122 and toner feeding box 123 of the cartridge case 121 in the developer cartridge 120 as shown in FIG. 6. A toner feeding duct 132 (developer path) communicating between the development housing 122 and toner feeding box 123 is provided at both ends out of the scanning path 131 of the cartridge case 121.

Accordingly, the toner feeding box 123 is disposed at the upstream side (corresponds to an upper side in this example) of the latent image writing position P of the photoreceptor drum 31, and the development housing 122 is disposed at the downstream side (corresponds to a lower side in this example) of the latent image writing position P.

The toner agitator 130 (the first stirring-and-conveying member) disposed in the toner feeding box 123 comprises a shaft 130*a* and wire winding parts 130*b* having different winding directions with each other in the directions from the center of the axis direction to both ends of the shaft 130*a*. The shaft 130*a* and wire winding parts 130*b* are composed of a string of the wire. Accordingly, the developer stored in the toner feeding box 123 can be fed to the toner feeding ducts 132 at both sides in the axis direction as the toner agitator 130 rotates, and the developer is fed to the development housing 122 through the toner feeding duct 132.

A dispensing auger 129 (the second stirring-and-conveying member) disposed in the development housing 122 comprises an axis 129*a* and screw shafts comprising screw portions 129*b* formed in different directions with each other from the end in the axis direction of the axis 129*a* to the center. A larger amount of the developer is delivered from the toner feeding ducts 132 at both sides to the center direction by allowing the dispensing auger 129 to rotate, and the developer is fed to the successive agitator 128 with uniform dispersion secured.

It is preferable that a width (reference character "S" in FIG. 6) of the toner feeding duct 132 (developer path) is in a range of about 1% to about 10% with respect to the length of the first developer storage portion in the longitudinal direction thereof. More specifically, the width S is preferably in a range of about 5 mm to about 30 mm. Such range as defined above is the optimum range in which it becomes possible to supply a suitable amount of a developer from the first developer storage portion to the second developer storage portion, in relation to the fluidity of the developer of the present invention.

An operation of the image forming apparatus according to the embodiment of the invention will be described below.

A visible image (toner image) is formed using the developing device 34 after electrically charging the photoreceptor drum 31 employing the charging device 32, and forming a latent image on the photoreceptor drum 31 by the exposing device 33.

On the other hand, a sheet is delivered from the sheet feeding device 22 to the sheet conveying path 23 at a given timing, and travels to the transferring part after positioning the sheet with the resist roll 24.

The toner image on the photoreceptor drum 31 is transferred onto the sheet using the transferring device 35. After fixing the unfixed toner image on the sheet with the fixing device 25, the sheet on which the image has been fixed is discharged into the discharging tray 27. The remaining toner on the photoreceptor drum 31 is cleaned using the cleaning device 36.

In the imaging process as described above, since the scanning light emitted from the exposing device 33 arrives at the latent image writing position P of the photoreceptor drum 31 through the scanning path 131 of the process cartridge 40, there is no apprehension that the process cartridge 40 might affect a scanning ability of the exposing device 33.

While the development housing 122 of the developer cartridge 120 and the toner feeding box 123 are vertically separated with each other with interposition of the latent image writing position P of the photoreceptor drum 31, it is possible to supply the toner without impairing the scanning ability since they are communicating with each other through the toner feeding ducts 132 running around the scanning path 131.

While the toner is consumed while the imaging process is going on in the developing device 34 (developer cartridge 120), the toner in the toner feeding box 123 is conveyed to the dispensing auger 129 of the development housing 122 through the toner feeding duct 132 as described above, and is sequentially supplied to inside of the development housing 122 in accordance with rotating of the dispensing auger 129.

The fresh toner supplied to the development housing 122 is conveyed in a direction of the developing roll via the developing agitator 128, and is fed to the developing roll 125 side by being stirred using an auxiliary agitator 127. A thickness of the developer retained in the developing roll 125 is controlled to provide a given thickness using the layer thickness-controlling blade 126, and is fed to the development region between the development roll and photoreceptor drum 31. Thus, the toner is supplied in accordance with consumption of the toner.

Since the toner feeding box 123 is positioned above the latent image writing position P of the photoreceptor drum 31 in this embodiment, a position of the bottom of the process cartridge 40 may be lifted up so as to remove the restriction to a layout of the sheet feeding device 22 disposed at the bottom of the apparatus 20.

Since the toner feeding box 123 is positioned at the upstream (upper side in this example) of the latent image writing position P of the photoreceptor drum 31 in this embodiment, the occupied space in the space above the scanning light line in the apparatus 20 increases. However, since the lower space of the discharging tray 27 in the apparatus 20 has inherently been a dead space which is only available for efficiently using it as the occupied space, the upper portion of the apparatus 20 is not required to be drastically changed.

In addition, there is no need for changing the upper portion (around the discharging tray 27) of the apparatus 20 if the upper space of the apparatus 20 is efficiently utilized, even when the supplying amount of the toner in the toner feeding box 123 is increased.

Accordingly, the apparatus 20 may be commonly used for constructing image forming apparatus having a variety of specifications. When the upper portion of the apparatus 20 is unavoidably changed, the portion may be slightly changed such that the position of the discharging tray 27 is slightly elevated.

EXAMPLES

The developer (toner) used in this embodiment will be described in detail by referring the following examples, while the invention is not restricted thereby.

A particle distribution and a volume average particle diameter of a toner are measured in a Coulter counter with an aperture diameter of 100 μm, particle size measuring equipment TA-II (trade name, manufactured by Coulter Corporation). In this case, measuring is conducted after the toner is dispersed in an aqueous electrolyte solution (ISOTON® II manufactured by Beckman Coulter Company) by bombarding with ultrasonic waves for 30 seconds.

A particle size (average particle diameter) of inorganic particles is determined from a scanning electron micrograph.

A measurement of molecular weight is carried out in the following conditions. "HLC-8120GPC, SC-8020 equipment (trade name, manufactured by Tosoh Corporation)" is used as a GPC. Two columns "TSK GEL, SUPER HM-H" (trade name, manufactured by Tosoh Corporation, 6.0 mm ID×15 cm) are used, and THF (tetrahydrofuran) is used as an eluting solvent. Experimental conditions are: sample concentration of 0.5%, current velocity of 0.6 ml/min., sample injection amount of 10 μl, measured temperature of 40° C., and use of an IR detector. Furthermore, an analytical curve is obtained from ten samples of "A-500", "F-1", "F-10", "F-80", "F-380", "A-2500", "F-4", "F-40", "F-128", and "F-700", which are polystyrene standard reagents TSK STANDARD (trade name, manufactured by Tosoh Corporation).

The melting point of a releasing agent and the glass transition temperature of a toner are determined from the maximum peak value of the main component measured according to ASTM D 3418-8.

For measuring the maximum peak value of the main component, DSC-7 (trade name, manufactured by Perkin Elmer Inc.) may be used. For the temperature correction of the detecting section in the equipment, melting points of indium and zinc are utilized, while the heat of fusion in indium is used for the correction for heat quantity. A pan made of aluminum is used for samples, while an empty pan is used as a control; and the measurement is conducted at 10° C./min. temperature rise rate.

Example 1

Using a Henschel mixer, 51.25 parts by weight of polyester resin (cross-linked polyester mainly containing propylene oxide adduct of bisphenol A and terephthalic acid; weight-average molecular weight of THF-soluble fraction: 12,000; Tg=58.5° C.), 45.0 parts by weight of a magnetic powder (saturation magnetization: 82 $Am^2/kg$; residual magnetization: 5.5 $Am^2/kg$; coercive force: 4.8 kA/m to 398 kA/m), 3.0 parts by weight of polypropylene wax (weight-average molecular weight: 3,000; melting point: 126° C.), and 0.75 part by weight of charge controlling agent (trade name T-77, manufactured by Hodogaya Chemical Co., Ltd.) are mixed. The resultant mixture is kneaded with heating using an extruder adjusted at 160° C.

After cooling, the kneaded mixture is crushed and pulverized followed by classification to obtain a classified toner having a volume average particle diameter of 7.8 μm and a proportion of the number of particles having a particle diameter of 4 μm or less of 15%. To 100 parts by weight of the classified toner obtained by mixing with Henschel mixer are externally added 0.5 parts by weight of a hydrophobic titanium compound particle and 1.2 parts by weight of silicone oil-treated silica particle (average particle diameter: 0.012 μm), and toner A is obtained as a toner for a first developer storage portion. The AR value of the toner A is 7.3. With regard to the hydrophobic titanium oxide compound particle, irmenite is used as titanium oxide to be dissolved in sulfuric acid to separate an iron powder, and 5 parts of $SiCl_4$ is added relative to 100 parts of $TiOSO_4$ obtained. After hydrolysis, $TiO(OH)_2$ containing a Si component is obtained by washing with water. The obtained product is used without sintering. 5 parts of decyltrimethoxy silane and 5 parts of silicone oil is treated in a wet state relative to 100 parts of $TiO(OH)_2$. Then the hydrophobic titanium oxide compound particle having an average particle diameter of 0.05 μm is obtained by drying and pulverizing using a jet mill. The silicone oil-treated silica particle is a commercially-available one that has a primary particle diameter of 0.012 μm (trade name: RY200, manufactured by Nippon Aerosil Co., Ltd.).

The toner A prepared as above is filled in a developer storage space (a first developer storage portion and a second developer storage portion) of a process cartridge being freely attachable to and detachable from an apparatus of an image forming apparatus, the process cartridge having a photoreceptor and a developing device having a developer storage space for storing a developer, in which the developer storage space is divided into a first developer storage portion and a second developer storage portion in a vertical direction such that a latent image writing position of the photoreceptor is interposed between the first developer storage portion and the second developer storage portion, and the first developer storage portion and the second developer storage portion communicate with each other through a developer path. In detail, 160 g of the toner A is filled into the first developer storage portion, and 510 g the toner A is filled into the second developer storage portion. This process cartridge is attached in a laser printer DocuPrint 360 (trade name, manufactured by Fuji Xerox Co., Ltd.), which has been modified for use with this process cartridge.

Figures 7, 7A:
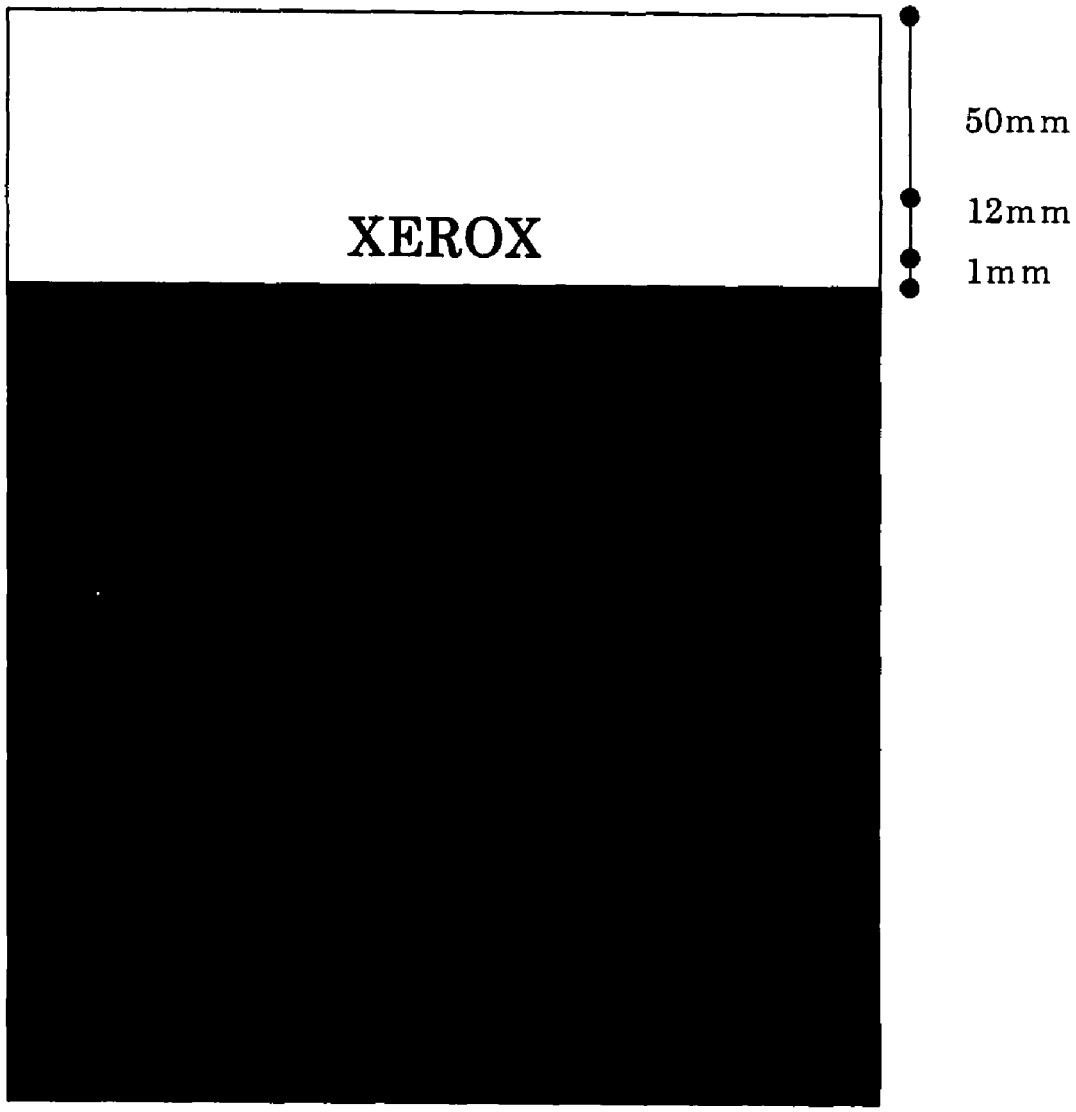
FIGS. 7A and 7B are examples of a layout of images of a word (printed letters) and a black solid picture image as well as are examples for evaluating uniformity in concentration of output.
Figure 7B:
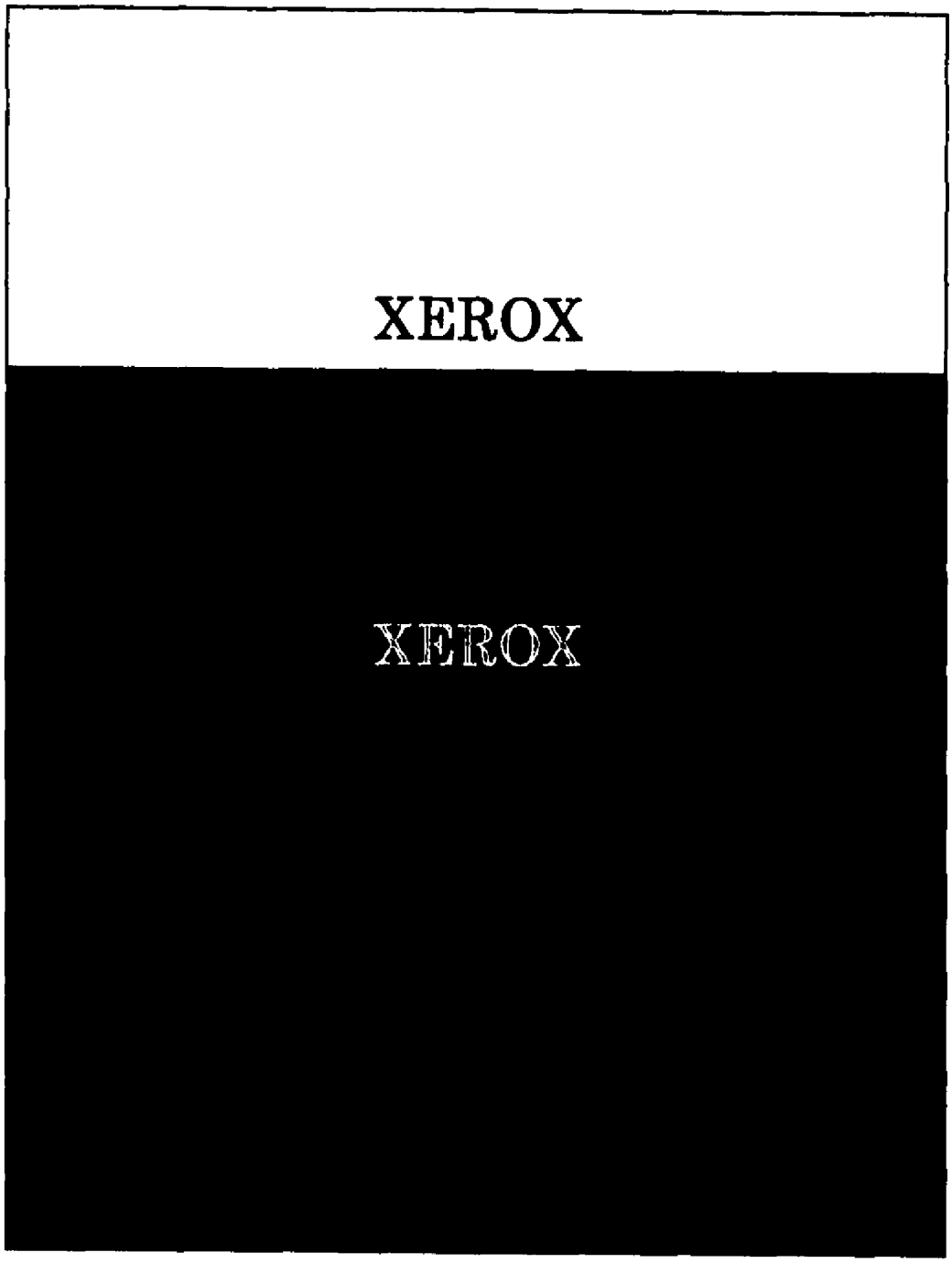

Under the conditions of temperature of 20° C. and humidity (RH) of 50%, a word "XEROX" having a size of 12 mm×12 mm is output at a position 50 mm from the edge of a sheet of A4 paper, and a black solid picture image is output at a position separated by 1 mm from the character. The layout of the word and the black solid picture image in the output is shown in FIG. 7A. The output process is repeated successively 20 times, and an evaluation test for uniformity in concentration of image wherein the word "XEROX" appears in the black solid picture image, is carried out by visual observation out of the 20th sheet. The results are shown in the following table 2 wherein "A" indicates a very good result in which no character-like image is observed, and there is no uneven density as shown in FIG. 7A; "B" indicates a result having no practical problem, although a very faint character portion appears; "C" indicates a permissible result, although a faint character portion appears; and "X" indicates a result containing significant uneven densities as shown in FIG. 7B, which are a problem from the practical point of view.

Example 2

Toner B is obtained and evaluated in the same manner as in Example 1, except that the classified toner is prepared so as to have a volume average particle diameter of 9.0 μm and a proportion of the number of particles having a particle diameter of 4 μm or less of 10%, the silicone oil-treated silica particle is changed to have an average particle diameter of 0.10 μm, and the addition amount the silicone oil-treated silica particle is changed to be 0.8 parts by weight. Results of evaluations thereof are shown in the following Table 2. The AR value of the toner B is 9.8.

Example 3

Toner C is obtained and evaluated in the same manner as in Example 1, except that the classified toner is prepared so as to have a volume average particle diameter of 7.0 μm and a proportion of the number of particles having a particle diameter of 4 μm or less of 16%. Results of evaluations thereof are shown in the following Table 2. The AR value of the toner C is 5.1.

Example 4

Toner D is obtained and evaluated in the same manner as in Example 1, except that a polyethylene wax (trade name: POLYWAX 725, manufactured by Toyo Petrolite kabusiki Kaisha, melting point: 103° C.) is used in place of the polypropylene wax (weight average molecular weight: 3,000). Results of evaluations thereof are shown in the following Table 2. The AR value of the toner D is 5.7.

Comparative Example 1

Toner E is obtained and evaluated in the same manner as in Example 1, except that the classified toner is prepared so as to have a volume average particle diameter of 6.5 μm and a proportion of the number of particles having a particle diameter of 4 μm or less of 20%, and the silicone oil-treated silica particle is changed to have an average particle diameter: 0.008 μm. Results of evaluations thereof are shown in the following Table 2. The AR value of the toner E is 4.0.

Comparative Example 2

Toner F is obtained and evaluated in the same manner as in Example 1, except that the classified toner is prepared so as to have a volume average particle diameter of 11.0 μm and a proportion of the number of particles having a particle diameter of 4 μm or less of 5%, the addition amount of the hydrophobic titanium oxide compound particle is changed to 0.3 parts by weight, the silicone oil-treated silica particle is changed to have an average particle diameter: 0.10 μm, and the addition amount of is changed to 1.0 parts by weight. Results of evaluations thereof are shown in the following Table 2. The AR value of the toner F is 15.5.

The total energies of the first and the second deaeration treatments for measuring the ARs of each of Examples 1 to 4 and Comparative examples 1 and 2 are shown in Table 1.

TABLE 1

| | Example 1 | Example 2 | Example 3 | Example 4 | Comparative example 1 | Comparative example 2 |
|---|---|---|---|---|---|---|
| First | 15.6 | 16.1 | 14.3 | 21.2 | 17.7 | 26.9 |
| Second | 114.5 | 158 | 72.4 | 120.8 | 71.3 | 418 |
| AR value (1st/2nd) | 7.3 | 9.8 | 5.1 | 5.7 | 4.0 | 15.5 |

The results of evaluations of Examples 1 to 4 and Comparative examples 1 and 2 are shown in the following Table 2.

TABLE 2

| | Example 1 | Example 2 | Example 3 | Example 4 | Comparative example 1 | Comparative example 2 |
|---|---|---|---|---|---|---|
| Toner | Toner A (Dv*: 7.8, Ss*: 1.2) | Toner B (Dv*: 9.0, Ss*: 0.8) | Toner C (Dv*: 7.0 Ss*: 1.2) | Toner D (Dv*: 7.8, Ss*: 1.2) | Toner E (Dv*: 6.5, Ss*: 1.2) | Toner F (Dv*: 11.0, Ss*: 1.0) |
| AR value | 7.3 | 9.8 | 5.1 | 5.7 | 4.0 | 15.5 |
| Uniformity in Concentration | B | B | B | C | X | —*** |
| Clogging at Developer path | No | No | No | No | No | Occurred |

*Dv: Volume average particle diameter (μm)
**Ss: Amount of Silicone oil-treated silica (parts by weight))
***Unable to evaluate due to clogging.

As is understood from the above, Examples 1 to 4 exhibit almost no non-uniformity in concentration of image, and among these, Examples 1 to 3 provide remarkably excellent results.

CROSS-REFERENCE TO RELATED APPLICATION

This application claims priority under 35 USC 119 from Japanese Patent Application No. 2006-281479.

What is claimed is:

1. A developer comprising a one-component magnetic toner, an aeration ratio (AR) of the developer measured by a powder rheometer being in a range of about 5.0 to about 10.0.

2. The developer of claim 1, which further comprises an external additive of silica particles having a small diameter.

3. The developer of claim 2, which satisfies at least one of the following conditions (1) to (4):

(1) the amount contained of the silica particles having a small diameter with respect to 100 parts by weight of the developer is in a range of about 0.5 to about 1.5 parts by weight;

(2) a volume average particle diameter of the silica particles having a small diameter is in a range of about 0.005 to about 0.05 μm;

(3) a volume average particle diameter of the one-component magnetic toner is in a range of about 5 to about 15 μm; or (4) a particle size distribution of the one-component magnetic toner is such that a number percentage of particles of 4 μm or less is about 20% or less with respect to the total number of particles of the one-component magnetic toner.

4. The developer of claim 3, which satisfies at least the conditions (1) and (4).

5. The developer of claim 1, wherein the one-component magnetic toner comprises inorganic particles.

6. The developer of claim 5, wherein the inorganic particles comprises inorganic particles with a main component of titanium oxide or inorganic particles with a main component of silica.

7. A process cartridge comprising: a photoreceptor; and a developing device that comprises a plurality of developer storage portions and that makes visible a latent image formed on the photoreceptor by using a developer comprising a one-component magnetic toner having an aeration ratio (AR) measured by a powder rheometer being in a range of about 5.0 to about 10.0.

8. The process cartridge of claim 7, wherein the developer further comprises an external additive of silica particles having a small diameter.

9. The process cartridge of claim 8, which satisfies at least one of the following conditions (1) to (4):

(1) the amount contained of the silica particle having a small diameter with respect to 100 parts by weight of the developer is in a range of about 0.5 to about 1.5 parts by weight;

(2) a volume average particle diameter of the silica particle having a small diameter is in a range of about 0.005 to about 0.05 μm;

(3) a volume average particle diameter of the one-component magnetic toner is in a range of about 5 to about 15 μm; or (4) a particle size distribution of the one-component magnetic toner is such that a number percentage of particles of 4 μm or less is about 20% or less with respect to the total number of particles of the one-component magnetic toner.

10. The process cartridge of claim 9, which satisfies at least the conditions (1) and (4).

11. The process cartridge of claim 7, wherein the one-component magnetic toner comprises inorganic particles.

12. The process cartridge of claim 11, wherein the inorganic particles comprises inorganic particles with a main component of titanium oxide or inorganic particles with a main component of silica.

13. An image forming apparatus comprising a process cartridge comprising: a photoreceptor; and a developing device that comprises a plurality of developer storage portions and that makes visible a latent image formed on the photoreceptor by using a developer comprising a one-component magnetic toner having an aeration ratio (AR) measured by a powder rheometer being in a range of about 5.0 to about 10.0.

14. The image forming apparatus of claim 13, which further comprises silica particles having a small diameter.

15. The image forming apparatus of claim 14, which satisfies at least one of the following conditions (1) to (4):

(1) the amount contained of the silica particles having a small diameter with respect to 100 parts by weight of the developer is in a range of about 0.5 to about 1.5 parts by weight;

(2) a volume average particle diameter of the silica particles having a small diameter is in a range of about 0.005 to about 0.05 μm;

(3) a volume average particle diameter of the one-component magnetic toner is in a range of about 5 to about 15 μm; or (4) a particle size distribution of the one-component magnetic toner is such that a number percentage of particles of 4 μm or less is about 20% or less with respect to the total number of particles of the one-component magnetic toner.

16. The image forming apparatus of claim 15, which satisfies at least the conditions (1) and (4).

17. The image forming apparatus of claim 16, wherein the one-component magnetic toner comprises inorganic particles.

18. The image forming apparatus of claim 17, wherein the inorganic particles comprises inorganic particles with a main component of titanium oxide or inorganic particles with a main component of silica.

* * * * *